US005725705A

United States Patent [19]

Nagahama et al.

[11] Patent Number: 5,725,705

[45] Date of Patent: Mar. 10, 1998

[54] DUST-CONTROL MAT HAVING EXCELLENT DIMENSIONAL STABILITY AND METHOD OF PRODUCING THE SAME

[75] Inventors: Yuji Nagahama; Kazushi Sumimoto; Junji Taguchi, all of Suita, Japan

[73] Assignee: Duskin Co., Ltd., Japan

[21] Appl. No.: 527,138

[22] Filed: Sep. 12, 1995

[51] Int. Cl.[6] ..... B32B 3/02; D04H 11/08

[52] U.S. Cl. ..... 156/148; 156/72; 156/308.4; 156/309.6; 428/85; 428/95; 428/96

[58] Field of Search ..... 156/72, 148, 308.2, 156/308.4, 309.6; 428/85, 95, 96, 198

[56] References Cited

U.S. PATENT DOCUMENTS

| | | | |
|---|---|---|---|
| 4,069,361 | 1/1978 | Kumar | 428/235 |
| 5,198,278 | 3/1993 | Sumimoto | 428/95 |
| 5,445,860 | 8/1995 | Bova | 156/72 |
| 5,494,724 | 2/1996 | Lang | 428/95 |

FOREIGN PATENT DOCUMENTS

| | | |
|---|---|---|
| 0466308 | 1/1992 | European Pat. Off. . |
| 0604897 | 7/1994 | European Pat. Off. . |

*Primary Examiner*—Daniel Stemmer

[57] ABSTRACT

A dust-control mat having excellent dimensional stability during the processing, good pile-erecting property and excellent pattern expression, and a method of producing the same. The dust-control mat having excellent dimensional stability comprises a base in which a base fabric is composed of a woven fabric or a nonwoven fabric and a floss-like nonwoven fiber layer coupled to the base, wherein the floss-like nonwoven fiber layer contains low-melting fibers and is thermally fixed after pile yarns are implanted thereon. The invention further provides a method of producing the dust-control mat.

5 Claims, 1 Drawing Sheet

DUST-CONTROL MAT HAVING EXCELLENT DIMENSIONAL STABILITY AND METHOD OF PRODUCING THE SAME

BACKGROUND OF THE INVENTION 1. (Field of the Invention)

The present invention relates to a dust-control mat and to a method of producing the same. More specifically, the invention relates to a dust-control mat having excellent dimensional stability during the processing, favorable pile-erecting property and excellent pattern expression, and to a method of producing the same. In this specification, the dust-control mats refer to those mats that are laid in porches and entrances of shops, hotels, hospitals, offices and houses through where people go in and out, in order to remove dust and dirt adhered to the bottoms of the shoes so that dust and dirt are prevented from entering into indoors.

2. (Description of the Prior Art)

The dust-control mats are mostly taffeting mats having a front surface made of a fibrous material and a back surface made of a rubber or a resin.

There has heretofore been employed a method of producing mats by implanting piles on a base fabric, applying, as required, a latex onto the non-pile surface, and adhering a solid rubber to the non-pile surface by the application of heat and pressure.

The base fabric may generally be either a woven fabric or a nonwoven fabric, which is used as carpet.

The latex of any type can be used such as SBR, NBR or the like. However, it has been known that NBR is particularly favorable from the standpoint of resistance against oils and resistance against washing.

Piles are implanted by a customary method such as taffeting, hooking, etc.

The piles to be implanted may be of any type such as filaments of nylon, acryl, polyester, cotton, rayon or vinylon, or may be of the spun type.

The solid rubber (unitary type) is often adhered depending upon the type of the mat; i.e., the solid rubber is cut into a regular size, and the uncured solid rubber is adhered to the non-pile surface under the application of heat and pressure to effect the curing.

In producing the mats, so far, a problem arouses in that when a rolled starting fabric obtained by implanting piles on the base fabric is treated with latex, is cut, or is adhered with a solid rubber, the mat is distorted, bent, and is permanently folded due to the external force applied to the starting fabric. In the dust-control mats that have characters or straight patterns, such a distortion or deformation that remains deteriorates the appearance and quality of the goods. The thus distorted mat produces force that works to assume the original straight form after it is repetitively used, washed and dried. As a result, the whole mat is undulated and is warped, causing the life (rental life) to be shortened.

This will be described in further detail. The starting fabric obtained by implanting piles on the base fabric is better long as much as possible from the standpoint of working efficiency, and a long starting fabric has been used in practice. Here, the long starting fabric must be rolled up or must be stacked being folded on a pallet. In this case, however, the starting fabric is distorted or is permanently folded.

When the starting fabric is to be coated with latex, in general, tension is given to the starting fabric in the direction of width by using pin-like tenter, the starting fabric is continuously coated with latex using a coating roll, followed by drying to diffuse the water in the latex. In this case, however, the distortion of about 5 cm/m in the direction of width could not be avoided due to external force that is applied, small amounts of deviation in the speed and tension on the right and left sides in the direction of width, deviation in the starting fabric-starting fabric junction, and error.

SUMMARY OF THE INVENTION

The object of the present invention therefore is to provide a dust-control mat free from the above-mentioned defects inherent in the conventional dust-control mats, and having dimensional stability during the processing, favorable pile-erecting property and excellent pattern expression, as well as to provide a method of producing the same.

According to the present invention, there is provided a dust-control mat having excellent dimensional stability comprising a base fabric, piles implanted on one surface of the base fabric, and an elastomer backing applied to the non-pile surface of the base fabric, wherein the base fabric comprises a base of a woven fabric or a nonwoven fabric and a floss-like nonwoven fiber layer bonded to the base, said floss-like nonwoven fiber layer contains low-melting fibers, and the floss-like nonwoven fiber layer after the pile yarns are implanted is thermally fixed.

According to the present invention, furthermore, there is provided a process for producing a dust-control mat having excellent dimensional stability comprising; a step for preparing a base fabric by bonding a floss-like nonwoven fiber layer comprising staple fibers or filament fibers in which low-melting fibers uniformly dispersed to a base of a woven fabric or a nonwoven fabric by such means as needle punching or dot-like heat adhesion; a step for preparing a starting fabric by implanting piles onto the base fabric by taffeting or hooking; a step for partly melt-adhering the piles and the base fabric, and the fibers in the base fabric by heat-treating the starting fabric so as to melt or soften the low-melting fibers; and a step for forming an elastomer backing on the non-pile surface of the starting fabric.

According to the present invention, a distinguished feature resides in that the floss-like nonwoven layer of the staple type or the filament type in which low-melting fibers are uniformly dispersed is bonded to the base of a woven fabric or a nonwoven fabric, and the thermosetting is effected after the piles are implanted, making it possible to greatly improve dimensional stability, pile-erecting property and pattern expression.

First, the floss-like nonwoven fiber layer formed on the base does not at all impair the implantation of piles on the base fabric but rather works to improve the pile-erecting property of the piles that are implanted. After the piles are implanted onto the base fabric, the floss-like nonwoven fiber layer is thermally fixed, so that the low-melting fibers contained in the floss-like nonwoven fiber layer are melted or softened so as to be thermally adhered, whereby the implanted structure is fixed and is stabilized contributing to improving dimensional stability, pile-erecting property and pattern expression of the mat irrespective of the subsequent processing.

That is, according to the present invention, the floss-like nonwoven layer of the staple type or the filament type in which low-melting fibers (hereinafter often referred to as melt-adhering components) are uniformly dispersed, is bonded to the base of a woven fabric or a nonwoven fabric by such means as needle punching or dot-like heat adhesion, so that the low-melting fibers are uniformly dispersed and adhered on the surface of the base fabric. Then, piles are implanted on the base fabric followed by the heat treatment, whereby the heat melt-adhering components are melted and softened to effectively accomplish the adhesion between the piles and the base fabric and among the fibers in the base fabric. At this moment, it is allowed to impart dimensional stability to the base fabric and, particularly, to impart resistance against the external force such as rolled packaging or folding of the starting fabric.

Adhesion is also accomplished between the implanted piles and the base fabric making it possible to increase resistance against taking out the piles and, hence, to obtain a starting fabric in which the base fabric and the piles are melt-adhered together exhibiting flexibility and elasticity-recovering property.

The base fabric has a double structure consisting of the base of a woven fabric or a nonwoven fabric and the floss-like nonwoven fiber layer. With the melt-adhering components being dispersed in the floss-like nonwoven fiber layers it was learned that there is almost no difference in the flexibility of the starting fabric that is melt-treated before and after the heating.

This makes a fundamental difference from the conventional non-woven fabrics in which heat melt-adhering components are mixed. In the nonwoven fabrics, the melt-adhering components are uniformly distributed over the whole base fabric, and the starting fabric after melt-adhered has a large hardness. When the starting fabric is used as a base fabric for dust-control mats, therefore, stress is concentrated in the starting fabric due to folding as a result of the repetition of washing and drying, resulting in the occurrence of breakage and the like and causing the life to be shortened. The present invention, however, is free from such defects. In the conventional nonwoven fabrics in which the melt-adhering components are uniformly dispersed, furthermore, partly low-melting fibers exist at a low concentration, and it is difficult to obtain an adhesive force which is so large as to adhere the piles and the base fabric together. If it is attempted to increase the adhesive force by increasing the ratio of the melt-adhering components, the life of the starting fabric tends to be shortened due to an increase in the rigidity of the base fabric. As will be described later, however, the present invention makes it possible to obtain excellent adhering force despite the melt-adhering components are contained at a low concentration.

According to the present invention, the base fabric can be favorably used either when it is composed of a nonwoven fabric or when it is composed of a woven fabric. When the melt-adhering components are added to the woven fabric, in particular, loose components in the outer periphery of the base fabric (base fabric components in parallel with the outer peripheral sides of the base fabric) are melt-adhered, too, preventing the fraying even after the mat is washed repetitively.

Particular effects obtained by the present invention are as described below. In the dust-control mats expressing characters such as "WELCOME" and the like and in the multicolor pile mats expressing designs drawn by the customers themselves, pile-erecting properties are distinctly improved and the pattern expression is very improved compared with those of the prior art. That is, in the mat of the present invention, piles of different colors infiltrate little in the boundaries, and the contours become very distinct.

In the conventional mat on which piles of different colors are implanted and, particularly, in the taffeted cut-pile mat, piles frequently fell on the portions of different colors due to the external force in the subsequent step, causing the appearance to become poor. The piles fell not only during the production but also during the washing and regeneration.

According to the present invention, the base is provided with a floss-like nonwoven fiber layer, and the low-melting points component are melted and softened by the step of heat melt-adhesion after the piles are implanted to effect the fixing by the heat adhesion, whereby pile-erecting property is produced and is stabilized.

The detailed mechanism is as described below. That is, when the base fabric is provided with the floss-like nonwoven fiber layer containing low-melting fibers followed by the implantation of piles, the piles are implanted on the base driving off the low-melting fibers. As a result, the concentration of the low-melting fibers increases in the outer peripheral portions of the piles by an amount that corresponds to a volume by which the piles are implanted.

Then, owing to the subsequent heat treatment, the outer peripheral portions of the piles are firmly fixed to reinforce pile-erecting property. Even through the subsequent processing steps, the boundaries are not disturbed and, as a result, there is obtained a dust-control mat having favorable pattern expression.

As the melt-adhering components, there can be used any known heat melt-adhering components of the type of polyester, polyolefin, polyamide, polyurethane or the like in such a structure as filaments, core-sheath structure, or the like. It is desired that the blending ratio is from 1 to 80% by weight in the floss-like nonwoven fiber layer (willowed cotton-like fiber layer).

DETAILED DESCRIPTION OF THE INVENTION

Figure 1:
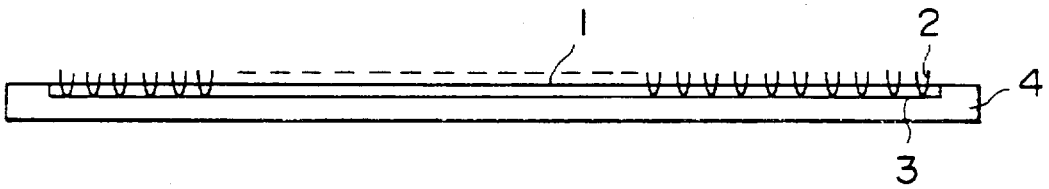
FIG. 1 is a sectional view illustrating a dust-control mat according to the present invention.

Referring to FIG. 1 illustrating a dust-control mat of the present invention, the mat comprises a base fabric 1, mat piles 2 taffeted on the base fabric 1, and a rubber backing 4 applied to a non-pile surface 3 of the base fabric.

Figure 2:
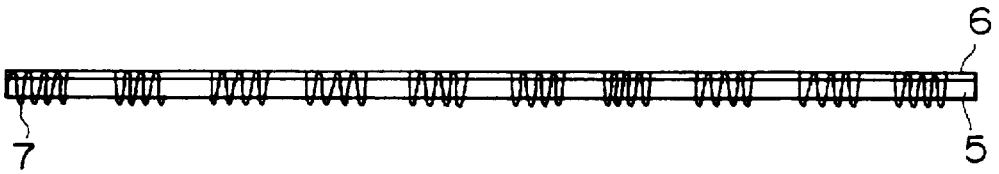
FIG. 2 is a sectional view illustrating the sectional structure of a base fabric on an enlarged scale.

Referring to FIG. 2 illustrating the structure of the base fabric in cross section, the base 1 comprises a composite of a base 1 of a woven fabric or a nonwoven fabric and a floss-like nonwoven layer 6 containing filaments of the filament type or the spun type, the floss-like nonwoven layer 6 being needle-punched 7 through the base. In the floss-like nonwoven fiber layer 6 are uniformly dispersed low-melting fiber, and fibers in the floss-like nonwoven fiber layer, base fabric and piles 2 are heat-adhered together.

The base may be any one of the woven fabric, nonwoven fabric or knitted fabric, and the fibers constituting it may be any synthetic fiber such as polyester fiber, polyamide fiber, acrylic fiber, or ultra-high molecular polyolefin fiber. It is most desired that the fibers are composed chiefly of a high molecular thermoplastic polyester and, particularly, polyethylene terephthalate or an ethylene terephthalate.

As the polyester fibers constituting the base woven fabric, there can be used film-like yarns obtained by strongly drawing a polyester film to increase its tensile strength and dividing it into a predetermined width.

In the case of the woven fabric, there is no particular limitation in the woven structure and a plain weaving is sufficient. As required however twill or any other modified weaving may be employed. In the case of the nonwoven fabric, there may be employed a spun-bonded nonwoven fabric, a melt-blown nonwoven fabric or a combination thereof.

It is desired that the weight of the base is, generally, from 50 to 500 g/square metes though it may vary depending upon the weight of the mat.

It is desired that the floss-like nonwoven layer consists of any synthetic fiber such as polyester fiber, polyamide fiber, acrylic fiber, or ultra-high molecular polyolefin fiber in the same manner as described above. It is, however, most desired that the floss-like nonwoven layer consists of a high molecular thermoplastic polyester and, particularly, a thermoplastic copolyester composed chiefly of a polyethylene terephthalate or an ethylene terephthalate.

As the low-melting fibers included in the floss-like nonwoven fiber layer, there can be used any known melt-adhering yarns of low-melting polyester, polyolefin, polyamide or polyurethane. The low-melting fibers have a melting point lower than those of other fibers and, generally, have a melting point of from 60° C. to 200° C.

Low-melting melt-adhering fibers are, usually, obtained by incorporating a copolymerizable component in the fiber-forming polymer. A preferred example of the low-melting fibers can be represented by a low-melting copolymerized polyester and, particularly, a poly(ethylene terephthalate/isophthalate). Another preferred example of the low-melting fibers can be represented by a low-melting copolymerized polyamide.

The low-melting fibers may be composed of the above-mentioned low-melting copolymer alone, or may be composite fibers of the low-melting copolymer and other ordinary fiber-forming polymers, such as composite fibers of a core-shell structure or a bimetal (side-by-side) structure.

It is desired that the low-melting fibers are mixed in an amount of from 1 to 80% by weight and, particularly, from 5 to 50% by weight in the floss-like nonwoven fiber layer. That is, when the amount is smaller than the above-mentioned range, the effect for stabilizing the dimension becomes poorer than when the amount lies within the above-mentioned range. When the amount exceeds the above-mentioned range, on the other hand, the low-melting fibers lose flexibility.

At least one layer of the web for forming the floss-like nonwoven fiber layer is placed on at least the upper side (pile side) or both sides of the base composed of a woven fabric or a nonwoven fabric and the base and the floss-like nonwoven layer are fastened together as a unitary structure by the needle punching based upon widely known means. The web remains in a very bulky state which is maintained even after the needle punching.

It is desired that the fibers constituting the floss-like nonwoven layer have sizes of single yarns of, generally, from 0.1 to 50 deniers and, particularly, from 1 to 20 deniers, and the single yarns may be so-called filaments or staple yarns. It is desired that the floss-like nonwoven layer is a guarding web but may be a spun-bonded web. The weight of the floss-like nonwoven layer is, usually, from 20 to 500 $g/m_2$ and is desirably over a range of from 5 to 200% of the base. Desirably, the concentration of the needle punching is, usually, not smaller than 1000 punches/$m^2$.

The pile yarns to be driven into the base fabric will be spun yarns of one or two or more kinds of cotton fiber, rayon fiber, polyvinyl alcohol fiber, acryl fiber, nylon fiber or other synthetic fibers, or may be multi-filament yarns. It is desired that the length of the taffeted pile is, usually, over a range of from 3 to 20 mm. The pile may be a cut pile, a loop pile, and may further be crimped or non-crimped. Besides, the pile length may be constant or different and may, for example, be a high cut-low loop, etc. The total thickness of the pile can be greatly changed over a range of from 300 to 10000 denier. The piles can be driven under the known conditions, and the number of gauges may be from 3 to 20 and the number of stitches may be from 3 to 20 over an inch.

The starting fabric obtained by implanting piles on the base fabric is then subjected to the heat fixing (heat treatment). The heat treatment is to melt the low-melting fibers and is effected by heating the starting fabric at a temperature higher than the melting point of the low-melting fibers. The starting fabric is heat-treated such that no distortion remains in the subsequent treatment. It is therefore important that the starting fabric is heat-treated in a free state so that no locking force acts upon the starting fabric. It is desired that the heating is carried out using the hot-air circulation furnace, infrared-ray heating or steam heating. The copolymerized polyamide and the copolymerized polyester have wet melting points which are lower than their dry melting points. Therefore the steam heating serves as an effective heat-treating means.

As the rubber sheet that serves as a backing, there can be used a variety of elastomer polymers such as nitrile-butadiene rubber (NBR), styrene-butadiene rubber (SBR), chloroprene rubber (CR), polybutadiene (BR), polyisoprene (IIB), butyl rubber, natural rubber, ethylene-propylene rubber (EPR), ethylene-propylene-diene rubber (EPDM), polyurethane, chlorinated polyethylene, chlorinated polypropylene, soft vinyl chloride resin, etc. It is, however, desired to use the nitrile-butadiene rubber (NBR) from the standpoint of resistance against oils and weatherability.

The rubber sheet that is formed may be blended with known blending agents such as sulfur or organic curing agent, cure promoting agent, softening agent, anti-aging agent, filler, dispersant, plasticizer, coloring agent and the like agents in known amounts.

In forming a mat as a unitary structure, the above-mentioned rubber composition is kneaded using a roll, Bumbury's mixer or the like. The composition is then molded into a sheet and on which is then placed a taffeted mat. The laminate is then heated and pressurized in a pressurizing mold to effect the adhesion and curing simultaneously.

To increase the adhesion between the rubber sheet and the base fabric, the non-pile surface of the base fabric may be coated with a rubber latex of the same kind as the rubber sheet. Or, an adhesive agent such as an ethylene acetate/vinyl copolymer or an adhesion promoting agent may be applied thereto in advance.

It is desired that the weight of the rubber sheet lies within a range of from 500 to 4000 g/$m^2$, and the rubber sheet and the base fabric are adhered together as a unitary structure in such a manner that the edges of the rubber sheet slightly protrude outwardly beyond the edges of the base fabric.

The adhesion by curing is better carried out at a temperature of from 100 to 200° C. under a pressure of from 0.1 to 20 kg/$mm^2$.

The present invention can be applied to not only the mat obtained by adhering the rubber sheet to the starting fabric as a unitary structure but also to the mat of the so-called separate type in which the mat is used being placed on a separate rubber sheet base.

In this case, the latex of the elastomer may be applied onto the non-pile surface of the starting fabric followed by curing.

It is desired that the amount (solid component) of the latex is from 50 to 3000 g/m$^2$.

The pile yarns of the mat of the present invention work to adsorb and hold dust and dirt adhered to the bottoms of the shoes. To further enhance this action, the pile yarns may be coated or impregnated with a dust-adsorbing oil. As the dust-adsorbing liquid, there can be used mineral oils such as fluidized paraffin, spindle oil, alkyl benzene oil, diester oil and castor oil, or synthetic oils or plant oils, or aqueous dust-adsorbing agents disclosed in Japanese Patent Publications Nos. 1019/1978 and 37471/1978. In general, the adsorbing agent is applied in an amount of from 0.01 to 200 g/m$^2$.

EXAMPLES

The invention will now be concretely described by way of the following Examples.

(Example 1)

Piles: BCF nylon 6 stitches/inch, gauge 5/32 pile length 9 mm, weight 880 g/m$^2$, cut piles Latex: NBR latex 300 g/cm$^2$ (solid content 46%)

By using the following base fabrics A and B, samples were prepared and were regarded to be Examples 1-A and 1-B.

The base fabrics A and B were taffeted with the above-mentioned pile constitution, and Example 1-B was continuously heat-treated at 180° C. for 5 minutes.

The above-mentioned starting fabric was coated with the latex, dried at 175° C. for 15 minutes, cut into a piece of 70×85 cm, and was heated and cured with the application of pressure together with an uncured rubber sheet having a thickness of 1.8 mm at a temperature of 170° C. for 15 minutes under a pressure of 10 kg/cm$^2$.

Base fabric A: polyester plain woven fabric 200 g/m$^2$

Base fabric B: polyester plain woven fabric 150 g/m$^2$ *polyester cotton 100 g/m$^2$ (weight ratio of low-melting floss-like fiber, 25%)

The polyester cotton was punch-worked with a needle.

The above-mentioned mat was cut and was measured for its deformation degree in the stitch and gauge directions concerning 50 samples (Table 1).

The above mat was placed on a place through where 2000 people walk a day for three days and was then washed. This was repeated 40 times. After 10 times, a change in the pattern was measured relying upon the number of piles that are infiltrating (Table 2).

TABLE 1

| Deformation degree mm | A | B |
|---|---|---|
| Stitching direction | 3 mm | 0 mm |
| Gauge direction | 34 mm | 0.5 mm |

TABLE 2

| | A | B |
|---|---|---|
| After 1 time | 55 piles | 5 piles |
| After 10 times | 83 piles | 4 piles |

A change in the pattern was measured based upon the number of black piles that have infiltrated into white piles.

(Results)

From Table 1, effect is obviously recognized in the deformation degree of the pattern of the starting fabric. From Table 2, difference is obviously recognized in the number of piles that have infiltrated. Even after used 40 times, no undulation or breakage is observed in the mat B.

In the mat A, undulation of about 2 mm to 5 mm is observed at about three places on a side. In the mat B as described above, the pattern of the starting fabric is not deformed, good pile-erecting property is maintained, and undulation does not take place.

According to the present invention, a floss-like nonwoven layer of the staple type or the filament type in which low-melting fibers are uniformly dispersed, is bonded to a base of a woven fabric or a nonwoven fabric and is, then, thermally fixed after the piles are implanted, making it possible to strikingly improve dimensional stability of the mat, pile-erecting property and pattern expression.

We claim:

1. A process for producing a dust-control mat comprising:

providing a woven or nonwoven fabric sheet and a flossy nonwoven fiber web containing low-melting fibers;

preparing a base cloth by bonding the flossy nonwoven fiber web to said sheet by needle punching or spot heat-adhering;

implanting piles onto one surface of the base cloth by tuffeting from a side of the web of the base cloth;

heat-treating the base cloth so as to melt or soften the low-melting fibers in the flossy nonwoven fiber web and to fix the piles on the base cloth; and forming an elastomer backing on a non-pile surface of the base cloth.

2. A process according to claim 1, wherein the flossy nonwoven fiber web contains the low-melting fibers in an amount of 5 to 50% by weight.

3. A process according to claim 1, wherein the low-melting fibers are at least one selected from the group consisting of low-melting copolymerized polyester fibers, low-melting copolymerized polyamide fibers and low-melting copolymerized polyolefin fibers.

4. A process according to claim 1, wherein the flossy nonwoven fiber web comprise staple fibers or filament fibers.

5. A process according to claim 1, wherein the woven or nonwoven fabric sheet has a weight of from 30 to 300 g/m$^2$, and the flossy nonwoven fiber web has a weight of from 50 to 90% by weight of the sheet.

* * * * *